US006312531B1

(12) United States Patent
Matsutani et al.

(10) Patent No.: US 6,312,531 B1
(45) Date of Patent: Nov. 6, 2001

(54) MAGNETIC COMPOSITE ARTICLE AND MANUFACTURING METHOD OF THE SAME AND SOFT MAGNETIC POWDER OF FE-AL-SI SYSTEM ALLOY USED IN THE COMPOSITE ARTICLE

(75) Inventors: Nobuya Matsutani, Katano; Yuji Mido, Higashiosaka; Kazuaki Onishi, Matsusaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/217,587

(22) Filed: Dec. 22, 1998

(30) Foreign Application Priority Data

Dec. 25, 1997 (JP) ..... 9-357078
Jan. 9, 1998 (JP) ..... 10-003010

(51) Int. Cl.[7] ..... C22C 33/02; H01F 1/047

(52) U.S. Cl. ..... 148/307; 148/110; 148/309; 148/306; 420/78

(58) Field of Search ..... 148/110, 309, 148/306, 307; 420/78

(56) References Cited

U.S. PATENT DOCUMENTS 4,299,622 * 11/1981 Kimira et al. ..... 75/124
4,985,089 * 1/1991 Yoshizawa et al. ..... 148/303
5,073,214 * 12/1991 Hirota et al. ..... 148/306
5,466,306 * 11/1995 Mishima et al. ..... 148/306
5,466,539 * 11/1995 Takayama ..... 428/611
5,580,399 * 12/1996 Tamai et al. ..... 148/301
5,651,841 7/1997 Hideharu et al. ..... 148/309

FOREIGN PATENT DOCUMENTS 06342714 12/1994 (JP) .
08037107 2/1996 (JP) .
9-125108 5/1997 (JP) .

OTHER PUBLICATIONS

M. Takahashi, et al. "Magnestostriction Constants for FDe–Al–Si (SENDUST) Single Crystals with D03 Ordered Structure" IEEE Transactions on Magnetics . . . vol. 23, No. 5, Sep. 1987, pp. 3523–3535.

T. Tanaka, et al., "Temperature dependence of the effective permability of the resin–molded Senduct alloys" Journal of Applied Physics . . . vol. 57, No. 1 Apr. 15, 1985, pp. 4252–4254.

* cited by examiner

*Primary Examiner*—Roy King
*Assistant Examiner*—Nicole Coy
(74) *Attorney, Agent, or Firm*—McDermott, Will & Emery

(57) ABSTRACT

Soft magnetic powder of Fe—Al—Si system of which magnetostrictive constant λ takes a positive value at the room temperature is employed to produce a magnetic composite article so that a temperature characteristic of core-loss of the article takes a negative value at the room temperature. Excellent magnetic characteristics such as a low core-loss and a high permeability can be obtained at a high frequency band.

6 Claims, 3 Drawing Sheets

MAGNETIC COMPOSITE ARTICLE AND MANUFACTURING METHOD OF THE SAME AND SOFT MAGNETIC POWDER OF FE-AL-SI SYSTEM ALLOY USED IN THE COMPOSITE ARTICLE

DESCRIPTION

1. Technical Field

The present invention relates to a magnetic composite article using soft magnetic powder of Fe—Al—Si system alloy that is employed in transformer-cores of power supplies, choke coils, or magnetic heads, and a manufacturing method of the same.

2. Background Art

Electric appliances and electronic devices have been downsized, which entails a demand for small and efficient magnetic articles. Ferrite cores and dust cores are thus employed as choke coils that are used at a high frequency band. The ferrite core has a problem of a low saturation-magnetic-flux-density, while the dust core formed by compacting magnetic powder has a substantially higher saturation-magnetic-flux-density than the ferrite core. The dust core has thus an advantage over the ferrite core in the way of downsizing appliances and devices.

On the other hand, the dust core is inferior to the ferrite core in regard to permeability and power loss. Because of these points, when the dust core is used as a choke coil or an inductor, a great amount of core loss raises the core temperature, which is an obstacle to downsizing.

The core loss of dust core comprises, in general, hysteresis loss and eddy current loss. The eddy current loss increases in proportion to the square of the frequency and the square of the size of eddy current i.e. the square of path length of the eddy current. Therefore, the magnetic-powder-surface is coated with insulating resin so that the dust core restrains itself from producing eddy current.

The dust core is formed generally with the compacting pressure of not less than 5 ton/cm$^2$. Its magnetostrictive is increased, while the permeability is lowered through this process. As a result, the hysteresis loss is increased. In order to release the magnetostrictive, a heat treatment has been applied to the dust core after the compacting. Some of the heat treatments are disclosed e.g. in the Japanese Patent Application Non-examined Publication Nos. H06-342714, H08-37107, and H09-125108.

However, a conventional dust core using powder of Fe—Al—Si system alloy has a drawback that the core loss increases in step with temperature rising. To be more specific, when a temperature coefficient of the core loss is positive around the room temperature, the transformer or choke coil produces heat due to the core loss during its active use. Its temperature thus rises and the core loss further increases, which induces a greater heat. This vicious circle is repeated to provoke a thermo-run-away.

In order to avoid the thermo-run-away, it is therefore crucial that the dust core should have a temperature characteristic such that the core loss is minimized at 80° C.–100° C. in an active use.

In general, the Fe—Al—Si system alloy shows its maximum permeability steeply around the composition of Si=9.6%, Al=5.5%, and the remainder of Fe (the figures are wt %) where the crystal magnetic anisotropy K≈0 and magnetostricitve constant λ≈0, as shown in FIGS. 2 and 3. The composition within this range is generally called "sendust". This maximum permeability was taken into consideration, and the magnetic composite articles employing the powder of Fe—Al—Si system alloy have been proposed, and some of them are disclosed in the patent gazettes of the Japanese Patent Application Non-examined Publication Nos. H06-342714, H08-37107 and H09-125108. However, no description about the relation between the core loss and the temperature characteristic is found in any of these proposals.

The temperature characteristic of the core-loss is determined by behavior of the hysteresis loss, i.e. the temperature characteristic of permeability. Ferrite in the conventional manner has shown its maximum permeability at a given temperature and shown also its minimum loss at the same point. This is because the crystal magnetic anisotropy K shows "0" at the given temperature, where magnetic domain walls can move with ease, and therefore, the hysteresis loss decreases. A conventional "sendust" dust-core employing the soft magnetic powder of Fe—Al—Si system alloy increases its core-loss monotonously as shown in FIG. 1 when the temperature is not lower than the room temperature. Therefore, this dust-core has been evaluated not good for a large-power transformer.

DISCLOSURE OF THE INVENTION

The present invention addresses these problems and aims to provide magnetic composite article having excellent characteristics such as a high permeability and a low-core-loss. A magnetic composite article according to the present invention employs soft magnetic powder of Fe—Al—Si system alloy, of which magnetostrictive constant λ is positive at the room temperature so that a temperature coefficient of the core loss at the room temperature is negative. The soft magnetic powder employed in the article preferably comprises 4.5%≦Al≦8.5%, 7.5%≦Si≦9.5%, and the remainder of Fe, (the figures are wt %). This structure realizes a core having a low core-loss even at a high frequency, an excellent temperature characteristic such that the temperature coefficient of the core loss is negative, and an excellent permeability.

However, according to the present invention, in a case of the magnetic composite article employing the soft magnetic powder of Fe—Al—Si system alloy, the crystal magnetic anisotropy K does not govern the temperature characteristic contrary to the established theory, but the magnetostricitive constant λ that has not drawn attention hitherto governs it. Further, the following fact is found. That is, when the magnetostrictive constant λ takes positive value at the room temperature (around 20–30° C.), the temperature coefficient of the core-loss has a negative inclination. In particular, when employing the soft magnetic powder of Fe—Al—Si system alloy that comprises 4.5%≦Al≦8.5%, 7.5%≦Si≦9.5%, and the remainder of Fe (the figures are wt %), the inventors can obtain an excellent temperature characteristic such as a high permeability and a low core-loss. Preferably the soft magnetic powder that comprises 5.0%≦Al≦6.5%, 8.2%≦Si≦9.2% and the remainder of Fe is used, whereby the more effective result is obtained.

DETAILED DESCRIPTION OF THE PREFERRED EMBODIMENTS

Exemplary Embodiment 1

Figure 1:
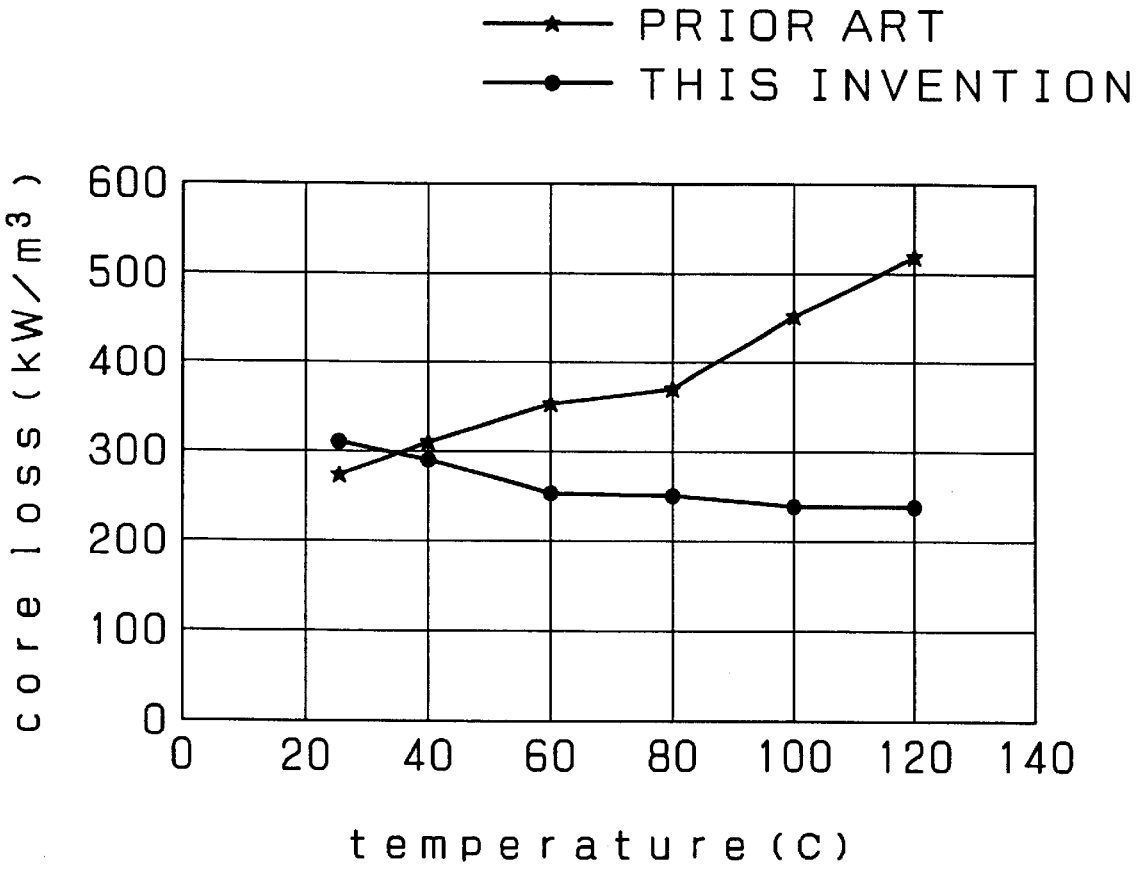
FIG. 1 shows a temperature characteristic of the core-loss of the present invention, compared with a prior art.
Figure 2:
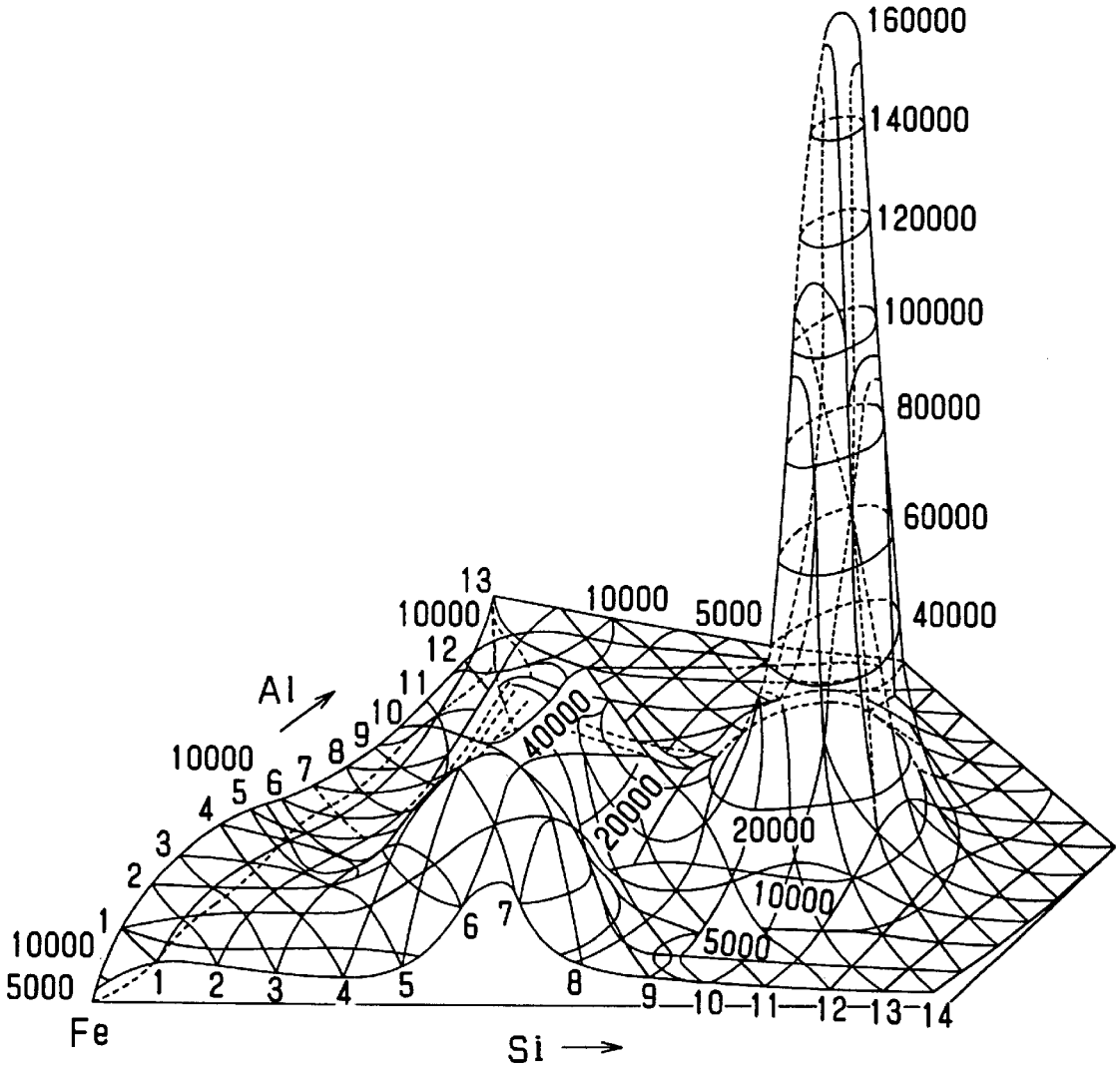
FIG. 2 shows how much the maximum permeability ($\mu_m$) of the Fe—Al—Si system alloy depends on the composition of Fe, Si and Al.
Figure 3:
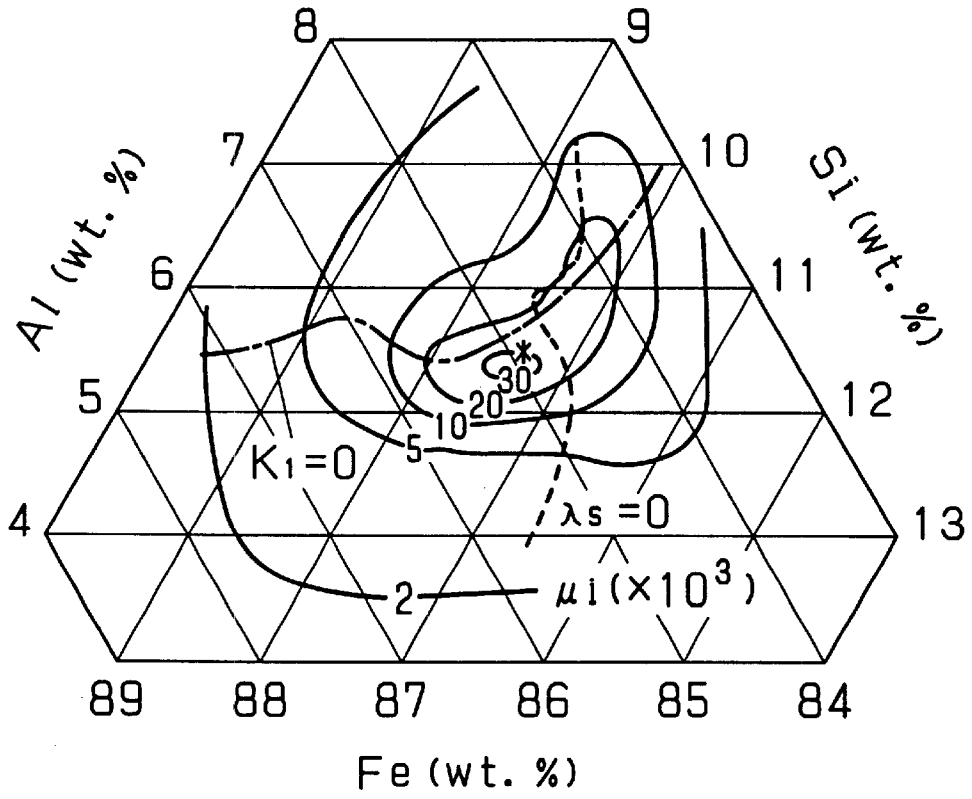
FIG. 3 shows how much an initial permeability ($\mu_i$) of the "sendust" at its center composition area depends on the composition of Fe, Si and Al.

The soft magnetic powder of Fe—Al—Si system alloy is produced by the water atomizing method so that its final composition is shown in Table 1. The volume content of oxygen in the powder show 2000–3000 ppm. The powder is sifted with a sieve so that an average grain size is 50 μm. The powder is mixed with butyral resin as an insulating binder by a mixer in the weight ratio of 100:2. A single axis press machine provides the mixed powder with compacting pressure of 10 ton/cm$^2$ to produce a toroidal compacted article of which dimension is outer diameter=25 mm, inner diameter=15 mm, thickness=10 mm. After this, heat treatment is provided to the resultant article at 690° C. in nitrogen gas, then silicone resin is impregnated therein. The samples are thus obtained.

The permeability of the sampless is measured with an LCR meter at 10 kHz. The core-loss thereof is measured with an ac B-H curve measuring device at 50 kHz and 0.1T magnetic flux density. Both of these values are measured from 20° C. to 120° C. with an interval of 20° C., and temperature characteristics of both the values are also measured. The values at the minimum loss temperature are shown in Table 1. In the case that the minimum loss temperature exceeds 120° C. or keeps under 20° C., the core-loss and permeability at these temperatures are shown. When the article is used for a choke coil of an active filter against harmonic distortion, the samples having the following excellent characteristics are obtained: core-loss≦1000 kW/m$^3$, permeability≧50 and the minimum-loss-temperature≧80° C., at the condition of measured frequency=50 kHz and measured magnetic flux density=0.1T.

As Table 1 shows, when the soft magnetic powder of Fe—Al—Si is used, which comprises 4.5%≦Al≦8.5%, 7.5%≦Si≦9.5%, and the remainder of Fe (the figures are wt %), the samples of a high permeability and a low core-loss are obtained. Preferably the soft magnetic powder of Fe—Al—Si is used, which comprises 5.0%≦Al≦6.5%, 8.2%≦Si≦9.2% and the remainder of Fe (the figures are wt %), to produce the more effective results.

Exemplary Embodiment 2

Soft magnetic powder is produced by an ingot grinding method so that the final composition thereof is Al=6.0%, Si=9.0%, and the remainder of Fe (the figures are wt %). The volume content of oxygen in each sample powder ranges from 1000 ppm to 2000 ppm. The powder is sifted with a sieve or an air classifying method so that an average grain size is as shown in Table 2. The magnetic powder is mixed with organic silicone resin as an insulating binder by a mixer in a weight ratio of 100:5. A single axis press machine provides the mixed powder with compacting pressure of 7 ton/cm$^2$ to produce a toroidal compacted article of which dimension is outer diameter=25 mm, inner diameter=15 mm, thickness=10 mm. After this, heat treatment is provided to the resultant article at 720° C. in nitrogen gas, then epoxy resin is impregnated therein. The samples are thus obtained.

The permeability of the samples is measured with an LCR meter at 10 kHz. The core-loss thereof is measured with an ac B-H curve measuring device at 50 kHz and 0.1T magnetic flux density. Both of these values are measured from 20° C. to 120° C. with an interval of 20° C., and temperature characteristics of both the values are also measured. The values at the minimum loss temperature are shown in Table 2. In the case that the minimum loss temperature exceeds 120° C. or keeps under 20° C., the core-loss and permeability at these temperatures are shown. When the article is used for a choke coil of an active filter against harmonic distortion, the samples having the following excellent characteristics are obtained: core-loss≦1000 kW/m$^3$, permeability≧50 and the minimum-loss-temperature≧80° C., at the condition of measured frequency=50 kHz and measured magnetic flux density=0.1T.

As shown in Table 2, the core-loss stays at a low level when the average grain size is between 1 μm and 100 μm, and preferably, the core-loss is ensured at a low level when the average grain size is between 1 μm and 50 μm.

TABLE 1

| Sample | Final composition (wt %) | | | Characteristics at minimum loss temperature | | | |
|---|---|---|---|---|---|---|---|
| | | | | Temperature | Core-loss | | |
| No. | Al | Si | Fe | (C.°) | kW/m$^3$ | Permeability | |
| 1 | 4.4 | 7.5 | Remainder | ≦120 | 1100 | 55 | Comparison |
| 2 | | 9.5 | Remainder | 80 | 1200 | 75 | Comparison |
| 3 | 4.5 | 7.4 | Remainder | ≧120 | 1210 | 80 | Comparison |
| 4 | | 7.5 | Remainder | ≧120 | 580 | 84 | Embodiment |
| 5 | | 9.5 | Remainder | 80 | 770 | 80 | Embodiment |
| 6 | | 9.6 | Remainder | 40 | 1100 | 72 | Comparison |
| 7 | 4.9 | 8.2 | Remainder | 100 | 500 | 80 | Embodiment |
| 8 | | 9.2 | Remainder | 100 | 550 | 78 | Embodiment |
| 9 | 5.0 | 8.1 | Remainder | 120 | 510 | 95 | Embodiment |
| 10 | | 8.2 | Remainder | 100 | 270 | 105 | Embodiment |
| 11 | | 9.2 | Remainder | 100 | 430 | 122 | Embodiment |
| 12 | | 9.3 | Remainder | 80 | 530 | 113 | Embodiment |
| 13 | 6.5 | 8.1 | Remainder | ≧120 | 520 | 90 | Embodiment |
| 14 | | 8.2 | Remainder | 100 | 220 | 95 | Embodiment |
| 15 | | 9.2 | Remainder | 100 | 220 | 118 | Embodiment |
| 16 | | 9.3 | Remainder | 80 | 580 | 115 | Embodiment |
| 17 | 6.6 | 8.2 | Remainder | 100 | 330 | 80 | Embodiment |
| 18 | | 9.2 | Remainder | 100 | 350 | 76 | Embodiment |
| 19 | 8.5 | 7.4 | Remainder | ≧120 | 1280 | 35 | Comparison |
| 20 | | 7.5 | Remainder | ≧120 | 850 | 56 | Embodiment |
| 21 | | 9.5 | Remainder | 80 | 900 | 52 | Embodiment |
| 22 | | 9.6 | Remainder | 60 | 1260 | 32 | Comparison |
| 23 | 8.6 | 7.5 | Remainder | ≧120 | 1350 | 35 | Comparison |
| 24 | | 9.5 | Remainder | 80 | 1170 | 35 | Comparison |

TABLE 2

| Sample No. | Average grain size (μm) | Characteristics at minimum loss temperature: Temperature (C.°) | Core-loss kW/m³ | Permeability | |
|---|---|---|---|---|---|
| 25 | 110 | ≧120 | 1370 | 125 | Comparison |
| 26 | 100 | ≧120 | 940 | 121 | Embodiment |
| 27 | 60 | ≧120 | 566 | 97 | Embodiment |
| 28 | 50 | ≧120 | 400 | 77 | Embodiment |
| 29 | 20 | ≧120 | 240 | 64 | Embodiment |
| 30 | 5 | ≧120 | 110 | 54 | Embodiment |
| 31 | 1 | ≧120 | 100 | 50 | Embodiment |
| 32 | 0.8 | ≧120 | 340 | 35 | Comparison |

Exemplary Embodiment 3

Soft magnetic alloy powder is produced by a water atomizing method so that the final composition thereof is Al=5.8 wt %, Si=8.6 wt % and the remainder of Fe, and the average grain size thereof is 30 μm. The resultant magnetic powder is mixed with butyral resin as an insulating binder and $TiO_2$ of which average grain size is 1 μm as a space control material by a mixer in a weight ratio of 100:1:0.5. The resultant mixed powder is deaerated and ground into granulation of which average grain size is not more than 500 μm. A single axis press machine provides the granulation with compacting pressure of 12 ton/cm$^2$ to produce a toroidal compacted article of which dimension is outer diameter=25 mm, inner diameter=15 mm, thickness=10 mm. Then the compacted article is degreased in the air at 450° C. After this, heat treatment is provided to the resultant article at 730° C. in nitrogen gas, then epoxy resin is impregnated therein. The samples are thus obtained.

The permeability of the samples is measured with an LCR meter at 10 kHz. The core-loss thereof is measured with an ac B-H curve measuring device at 50 kHz and 0.1T magnetic flux density. Both of these values are measured from 20° C. to 120° C. with an interval of 20° C., and temperature characteristics of both the values are also measured. The values at the minimum loss temperature are shown in Table 3. In the case that the minimum loss temperature exceeds 120° C. or keeps under 20° C., the core-loss and permeability at these temperatures are shown. When the article is used for a choke coil of an active filter against harmonic distortion, the samples having the following excellent characteristics are obtained: core-loss≦1000 kW/m$^3$, permeability≧50 and the minmum-loss-temperature≧80° C., at the condition of measured frequency=50 kHz and measured magnetic flux density=0.1T.

TABLE 3

| Sample No. | Oxygen volume (ppm) | Characteristics at minimum loss temperature: Temperature (C.°) | Core-loss kW/m³ | Permeability | |
|---|---|---|---|---|---|
| 33 | 900 | ≧120 | 1280 | 95 | Comparison |
| 34 | 1000 | ≧120 | 650 | 85 | Embodiment |
| 35 | 3000 | ≧120 | 670 | 82 | Embodiment |
| 36 | 5000 | ≧120 | 720 | 74 | Embodiment |
| 37 | 8000 | ≧120 | 780 | 70 | Embodiment |
| 38 | 8100 | ≧120 | 2430 | 35 | Comparison |

As shown in Table 3, a low core-loss is achieved when the volume content of oxygen stays between 1000 ppm and 8000 ppm.

Exemplary Embodiment 4

Soft magnetic powder of Fe—Al—Si system alloy is produced by a gas atomizing method so that the final composition thereof is as shown in Table 4. The powder is then sifted with a sieve so that an-average grain size is 60 μm. The sifted powder is mixed with butyral resin as an insulating binder by a mixer in the weight ratio of 100:5. A single axis press machine provides the granulation with compacting pressure of 7 ton/cm$^2$ to produce a toroidal compacted article of which dimension is outer diameter=25 mm, inner diameter=15 mm, thickness=10 mm. After this, heat treatment is provided to the resultant article at 710° C. in nitrogen gas, then silicone resin is impregnated therein. The samples are thus obtained.

The permeability of the samples is measured with an LCR meter at 10 kHz. The core-loss thereof is measured with an ac B-H curve measuring device at 50 kHz and 0.1T magnetic flux density. Both of these values are measured from 20° C. to 120° C. with an interval of 20° C., and temperature characteristics of both the values are also measured. The values at the minimum loss temperature are shown in Table 4. In the case that the minimum loss temperature exceeds 120° C. or keeps under 20° C., the core-loss and permeability at these temperatures are shown. When the article is used for a choke coil of an active filter against harmonic distortion, the samples having the following excellent characteristics are obtained: core-loss≦1000 kW/m$^3$, permeability≧50 and the minimum-loss-temperature≧80° C., at the condition of measured frequency=50 kHz and measured magnetic flux density=0.1T.

As Table 4 shows, when the soft magnetic powder of Fe—Al—Si is used, which comprises 4.5%≦Al≦8.5%, 7.5%≦Si≦9.5%, and the remainder of Fe (the figures are wt %), the samples of a high permeability and a low core-loss are obtained. Preferably the soft magnetic powder of Fe—Al—Si is used, which comprises 5.0%≦Al≦6.5%, 8.2%≦Si≦9.2%, and the remainder of Fe (the figures are wt %), to produce the more effective results.

TABLE 4

| Sample No. | Final composition (wt %) Al | Si | Fe | Characteristics at minimum loss temperature: Temperature (C.°) | Core-loss kW/m³ | Permeability | |
|---|---|---|---|---|---|---|---|
| 39 | 4.4 | 7.5 | Remainder | ≧120 | 1200 | 70 | Comparison |
| 40 | | 9.5 | Remainder | 80 | 1170 | 83 | Comparison |
| 41 | 4.5 | 7.4 | Remainder | ≧120 | 1210 | 87 | Comparison |
| 42 | | 7.5 | Remainder | ≧120 | 750 | 90 | Embodiment |
| 43 | | 9.5 | Remainder | 80 | 920 | 86 | Embodiment |
| 44 | | 9.6 | Remainder | 40 | 1070 | 82 | Comparison |
| 45 | 4.9 | 8.2 | Remainder | 100 | 550 | 85 | Embodiment |
| 46 | | 9.2 | Remainder | 100 | 530 | 84 | Embodiment |
| 47 | 5.0 | 8.1 | Remainder | 120 | 530 | 95 | Embodiment |
| 48 | | 8.2 | Remainder | 100 | 350 | 105 | Embodiment |
| 49 | | 9.2 | Remainder | 100 | 460 | 122 | Embodiment |
| 50 | | 9.3 | Remainder | 80 | 530 | 113 | Embodiment |
| 51 | 6.5 | 8.1 | Remainder | ≧120 | 510 | 98 | Embodiment |
| 52 | | 8.2 | Remainder | 100 | 210 | 104 | Embodiment |
| 53 | | 9.2 | Remainder | 100 | 250 | 110 | Embodiment |
| 54 | | 9.3 | Remainder | 80 | 600 | 115 | Embodiment |
| 55 | 6.6 | 8.2 | Remainder | 100 | 330 | 90 | Embodiment |
| 56 | | 9.2 | Remainder | 100 | 380 | 91 | Embodiment |
| 57 | 8.5 | 7.4 | Remainder | ≧120 | 1270 | 35 | Comparison |
| 58 | | 7.5 | Remainder | ≧120 | 880 | 60 | Embodiment |
| 59 | | 9.5 | Remainder | 80 | 930 | 57 | Embodiment |
| 60 | | 9.6 | Remainder | 60 | 1350 | 30 | Comparison |
| 61 | 8.6 | 7.5 | Remainder | ≧120 | 1370 | 42 | Comparison |
| 62 | | 9.5 | Remainder | 80 | 1250 | 37 | Comparison |

Exemplary Embodiment 5

Soft magnetic powder is produced by a gas atomizing method so that its final composition is Al=6.0 wt %, Si=9.0 wt % and the remainder of Fe. The powder is sifted with a sieve so that its average grain size is as shown in Table 5. The sifted magnetic powder is mixed with organic silicone resin by a mixer in the weight ratio of 100:3. A single axis press machine provides the granulation with compacting pressure of 9 ton/cm$^2$ to produce a toroidal compacted article of which dimension is outer diameter=25 mm, inner diameter=15 mm, thickness=10 mm. After this, heat treatment is provided to the resultant article at 730° C. in nitrogen gas, then epoxy resin is impregnated therein. The samples are thus obtained.

The permeability of the samples is measured with an LCR meter at 10 kHz. The core-loss thereof is measured with an ac B-H curve measuring device at 50 kHz and 0.1T magnetic flux density. Both of these values are measured from 20° C. to 120° C. with an interval of 20° C., and temperature characteristics of both the values are also measured. The values at the minimum loss temperature are shown in Table 5. In the case that the minimum loss temperature exceeds 120° C. or keeps under 20° C., the core-loss and permeability at these temperatures are shown. When the article is used for a choke coil of an active filter against harmonic distortion, the samples having the following excellent characteristics are obtained: core-loss≦1000 kW/m$^3$, permeability≧50 and the minimum-loss-temperature≧80° C., at the condition of measured frequency=50 kHz and measured magnetic flux density=0.1T.

As shown in Table 5, the core-loss stays at a low level when the average grain size is not greater than and 100 $\mu$m, and preferably, the core-loss is ensured at a low level when the average grain size is not greater than 50 $\mu$m.

TABLE 5

| Sample No. | Average grain size ($\mu$m) | Characteristics at minimum loss temperature: Temperature (C.°) | Core-loss kW/m³ | Permeability | |
|---|---|---|---|---|---|
| 63 | 110 | ≧120 | 1120 | 145 | Comparison |
| 64 | 100 | ≧120 | 950 | 125 | Embodiment |
| 65 | 60 | ≧120 | 620 | 135 | Embodiment |
| 66 | 50 | ≧120 | 460 | 100 | Embodiment |
| 67 | 20 | ≧120 | 260 | 85 | Embodiment |
| 68 | 5 | ≧120 | 120 | 62 | Embodiment |

Exemplary Embodiment 6

Soft magnetic powder is produced by a gas atomizing method so that the final composition thereof is Al=5.8 wt %, Si=8.6 wt % and the remainder of Fe, and the average grain size thereof is 40$\mu$m. The resultant magnetic powder is mixed with butyral resin as an insulating binder and MgO of which average grain size is 1 $\mu$m as a space control material by a mixer in a weight ratio of 100:1:1. The resultant mixed powder is deaerated and ground into granulation of which average grain size is not more than 500 $\mu$m. A single axis press machine provides the granulation with compacting pressure of 10 ton/cm$^2$ to produce a toroidal compacted article of which dimension is outer diameter=25 mm, inner diameter=15 mm , thickness=10 mm. Then the compacted article is degreased in the air at 450° C. After this, heat treatment is provided to the resultant article in nitrogen gas as shown in Table 6, then epoxy resin is impregnated therein. The samples are thus obtained.

The permeability of the samples is measured with an LCR meter at 10 kHz. The core-loss thereof is measured with an ac B-H curve measuring device at 50 kHz and 0.1T magnetic flux density. Both of these values are measured from 20° C. to 120° C. with an interval of 20° C., and temperature characteristics of both the values are also measured. The values at the minimum loss temperature are shown in Table 6. In the case that the minimum loss temperature exceeds 120° C. or keeps under 20° C., the core-loss and permeability at these temperatures are shown. When the article is used for a choke coil of an active filter against harmonic distortion, the samples having the following excellent characteristics are obtained: core-loss≦1000 kW/m$^3$, permeability≧50 and the minimum-loss-temperature≧80° C., at the condition of measured frequency=50 kHz and measured magnetic flux density=0.1T.

TABLE 6

| Sample No. | Heat treatment temperature | Characteristics at minimum loss temperature: Temperature (C.°) | Core-loss kW/m$^3$ | Permeability | |
|---|---|---|---|---|---|
| 69 | 480 | ≧120 | 1500 | 38 | Comparison |
| 70 | 500 | ≧120 | 850 | 80 | Embodiment |
| 71 | 630 | ≧120 | 590 | 90 | Embodiment |
| 72 | 650 | ≧120 | 350 | 114 | Embodiment |
| 73 | 800 | ≧120 | 470 | 115 | Embodiment |
| 74 | 820 | ≧120 | 660 | 125 | Embodiment |
| 75 | 900 | ≧120 | 770 | 135 | Embodiment |
| 76 | 920 | ≧120 | 3520 | 165 | Comparison |

As Table 6 shows, a low core-loss is realized when the temperature treatment is provided at the temperature ranging from 500° C. to 900° C. preferably, the lower core-loss is expected at the temperature ranging from 650° C. to 800° C.

Exemplary Embodiment 7

Soft magnetic powder (inventive article) is produced by a gas atomizing method so that the final composition thereof is Al=7.5 wt %, Si=8.5 wt % and the remainder of Fe. Another soft magnetic powder (conventional article) is produced by also the gas atomizing method so that its final composition is Al=5.4 wt %, Si=9.6 wt % and the remainder of Fe. Each powder is sifted with a sieve so that the average grain size of each is 40μm. The resultant magnetic powder is mixed with organic silicone resin as an insulating binder by a mixer in a weight ratio of 100:4. A single axis press machine provides each mixed powder with compacting pressure of 10 ton/cm$^2$ to produce a toroidal compacted article of which dimension is outer diameter=25 mm, inner diameter=15 mm, thickness=10 mm. After this, heat treatment is provided at 720° C. in nitrogen gas, then epoxy resin is impregnated therein. The samples are thus obtained.

FIG. 1 shows a temperature characteristic of core-loss at a measured frequency of 50 kHz and a measure magnetic flux of 0.1T. This characteristic graph tells that the inventive sample has a negative inclination around the room temperature (20° C.–30° C.) and a minimum loss temperature is 80° C. or more. The conventional article, on the other hand, has a positive inclination around the room temperature and a minimum loss temperature is not higher than 20° C., Therefore, the conventional sample has a possibility of thermo-run-away at a high temperature.

Exemplary Embodiment 8

Soft magnetic powder of Fe—Al—Si system alloy is produced with a water atomizing method so that its final composition is as shown in Table 7. Then the powder is sifted with a sieve so that its average grain size is 50 μm. The sifted magnetic powder is mixed with butyral resin as an insulating binder in a weight ratio of 100:1.5. A single axis press machine provides each mixed powder with compacting pressure of 10 ton/cm$^2$ to produce "E" and "I" shaped compacted articles. After this, heat treatment is provided to the resultant articles in nitrogen gas at 700° C., then epoxy resin is impregnated therein. The samples are thus obtained.

The "E" shaped and "I" shaped samples are combined into a power-choke-coil of DC/DC converter in a notebook type personal computer. This choke coil mounted in the active personal computer is evaluated at 200 kHz. Temperature-rise of this evaluation is shown in Table 7.

TABLE 7

| Sample No. | Final composition (wt %): Al | Si | Fe | Temperature rise (C.°) | |
|---|---|---|---|---|---|
| 77 | 5.0 | 8.1 | Remainder | 25 | Embodiment |
| 78 | 7.5 | 9.0 | Remainder | 60 | Embodiment |
| 79 | 4.0 | 7.0 | Remainder | 52 | Comparison |
| 80 | 8.5 | 9.6 | Remainder | 60 | Comparison |

As Table 7 shows, the temperature-rise is not higher than 30° C. when the soft magnetic powder is used, which comprises 4.5%≦Al≦8.5%, 7.5%≦Si≦9.5%, and the remainder of Fe (the figures are wt %.)

As the foregoing exemplary embodiments described, the magnetic composite article is formed by employing soft magnetic powder of Fe—Al—Si system alloy of which magnetostrictive constant λ is positive at the room temperature. Since the temperature coefficient of the core-loss at the room temperature can stay negative, excellent magnetic characteristics such as a low core-loss and a high permeability even at a high frequency range can be obtained. Preferably, the minimum loss temperature of the magnetic composite article is not lower than 80° C.

The magnetic composite article according to the present invention comprises mainly the soft magnetic powder of Fe—Al—Si system alloy and an insulating material such as remainders after the heat treatment of the insulating binder, resin for impregnation or hollow holes. In view of magnetic characteristics, a volume content of the soft magnetic powder is preferably between 70–99 volume %. The soft magnetic powder is preferably comprises 4.5%≦Al≦8.5%, 7.5%≦Si≦9.5%, and the remainder of Fe (the figures are wt %.) When a small amount of impurities or additive are included therein, as far as they do not negatively influence the magnetic characteristics, the same effect can be expected. The magnetic composite article can include magnetic powders other than the main component i.e. the soft magnetic powder of Fe—Al—Si system alloy.

Further preferably, the magnetic composite article formed with the following methods is employed to produce more stable and excellent magnetic characteristics, i.e. soft magnetic powder of Fe—Al—Si system alloy is turned into powder by a gas-atomizing, water-atomizing method, or is directly ground after being alloyed. The same result can be obtained when the soft magnetic powder can be shaped into anyone of spherical, compressed, or polygonal state. The article is preferably formed by the soft magnetic powder of Fe—Al—Si system alloy of which average grain size ranges from 1 μm to 100 μm. When the average grain size is smaller than 1 μm, the core compact becomes less densely whereby the permeability is lowered. Therefore, the powder of which average grain size is not less than 1 μm and preferably ranges from 1 μm to 50 μm is desirably used. The powder is preferably coated with an oxide film of not less than 5 nm thickness, the article of higher insulating and more effective to reduce the eddy current loss can be obtained.

The present invention provides the following manufacturing method of the magnetic composite article. 1) Mix the soft magnetic powder of Fe—Al—Si system alloy of which magnetostrictive constant λ is positive at the room temperature with electrical insulating binder, 2) apply compacting pressure, and 3) provide a heat treatment ranging from 500° C. to 900° C. The heat treatment after the compacting pressure contributes to reduce the hysteresis loss, whereby a stable and an excellent magnetic characteristics can be obtained.

The electrical insulating binder preferably consists mainly of at least one of epoxy resin, phenol resin, polyvinyl chloride resin, butyral resin, and organic silicone resin. Since the heat treatment is provided at the temperature ranges from 500° C. to 900° C., the ingredients of the binder preferably less diffuse into the magnetic powder, and a non-oxide atmosphere is preferred for the heat treatment in view of preventing the alloy powder from being oxidized. The heat treatment can be also provided in the air.

After the heat treatment, the magnetic composite article is preferably put into insulating impregnant. Because the heat treatment over 500° C. dissolves the binder such as resin, mechanical strength of the article is lowered, therefore, the insulating impregnant is impregnated into the article after the heat treatment so that the core strength is improved, magnetic powder is prevented from being oxidizing, and surface resistance is increased. Vacuum impregnation is preferred because the impregnant invades into inside of the core.

The soft magnetic powder of Fe—Al—Si system alloy according to the present invention comprises $4.5\% \leqq Al \leqq 8.5\%$, $7.5\% \leqq Si \leqq 9.5\%$, and the remainder of Fe (the figures are wt %). The volume content of oxygen preferably reanges from 1000 ppm to 8000 ppm, and the magnetostrictive constant λ is positive at the room temperature. When this material is used, the temperature coefficient of the core-loss at the room temperature can stay negative, therefore, excellent magnetic characteristics such as a low core-loss and a high permeability even at a high frequency can be produced. When the volume content of oxygen is 1000 ppm or more, the eddy current loss is decreased. Because the resistance value of the magnetic powder increases in step with the increasing of oxygen-volume-content, the eddy current loss is decreased. When the volume content of oxygen exceeds the upper limit of 8000 ppm, the hysteresis loss increases, the total core-loss thus increases.

What is claimed is:

1. A magnetic composite article comprising soft magnetic powder of Fe—Al—Si system alloy of which composition comprises 4.5% to 8.5% by weight of Al, 7.5% to 9.5% by weight of Si and the remainder of Fe, a magnetostrictive constant of said powder taking a positive value at a room temperature so that a temperature coefficient of core-loss takes negative value at the room temperature.

2. The magnetic composite article as defined in claim 1, wherein the core loss is minimized at not lower than 80° C.

3. The magnetic composite article as defined in claim 1, wherein said soft magnetic powder is manufactured by one of a gas atomizing method, a water atomizing method and a method of grinding melted alloy.

4. The magnetic composite article as defined in claim 1, wherein an average grain size of said soft magnetic powder is between 1 μm and 100 μm.

5. Soft magnetic powder of Fe—Al—Si system alloy for a magnetic composite article comprising 4.5% to 8.5% by weight of Al, 7.5% to 9.5% by weight of Si, and the remainder of Fe, wherein a volume content of oxygen is between 1000 ppm and 8000 ppm, and a magnetostrictive constant takes a positive value at a room temperature.

6. The soft magnetic powder of Fe—Al—Si system alloy as defined in claim 5, wherein said powder is manufactured by one of a water atomizing method and a method of grinding melted alloy.

* * * * *